US010918198B2

(12) United States Patent
Bickford et al.

(10) Patent No.: US 10,918,198 B2
(45) Date of Patent: Feb. 16, 2021

(54) APPARATUS WITH STRUCTURED STEM FOR COSMETIC APPLICATION

(71) Applicant: L'OREAL, Paris (FR)

(72) Inventors: William Bickford, Scotch Plains, NJ (US); Lemis Tarajano, Brooklyn, NY (US); Karin Kaskiel, New York, NY (US)

(73) Assignee: L'OREAL, Paris (FR)

( * ) Notice: Subject to any disclaimer, the term of this patent is extended or adjusted under 35 U.S.C. 154(b) by 0 days.

(21) Appl. No.: 16/288,800

(22) Filed: Feb. 28, 2019

(65) Prior Publication Data

US 2020/0275769 A1 Sep. 3, 2020

(51) Int. Cl.

| | |
|---|---|
| ***A45D 34/04*** | (2006.01) |
| ***A45D 40/26*** | (2006.01) |
| ***A46B 11/00*** | (2006.01) |
| ***A46B 9/02*** | (2006.01) |

(52) U.S. Cl.

CPC ..... *A46B 11/0072* (2013.01); *A45D 34/043* (2013.01); *A45D 34/045* (2013.01); *A46B 9/021* (2013.01); *A45D 40/265* (2013.01); *A46B 2200/1046* (2013.01)

(58) Field of Classification Search

CPC .... A45D 34/045; A45D 34/00; A45D 34/042; A45D 34/046; A45D 34/047; A45D 40/262; A45D 40/265; A45D 40/267; A45D 40/268; A46B 11/0072; A46B 9/021; A46B 2200/1046; A46B 11/0082; A46B 2200/1053

USPC ..... 401/126–130

See application file for complete search history.

(56) References Cited

U.S. PATENT DOCUMENTS

| | | | | |
|---|---|---|---|---|
| 2,396,058 | A | 3/1946 | Rath | |
| 4,076,428 | A | 2/1978 | Otake et al. | |
| 4,404,977 | A * | 9/1983 | Vasas | A45D 40/267 132/218 |
| 4,496,258 | A | 1/1985 | Tanaka et al. | |
| 4,841,996 | A * | 6/1989 | Gueret | A45D 34/04 132/320 |
| 6,312,182 | B1 * | 11/2001 | Dumler | A46B 9/021 401/129 |
| 7,086,799 | B1 | 8/2006 | Pappageorge et al. | |
| 8,070,374 | B2 * | 12/2011 | Gueret | A45D 34/045 401/126 |
| 9,696,241 | B2 | 7/2017 | Mao et al. | |
| 2003/0235454 | A1 * | 12/2003 | Gueret | A45D 40/267 401/126 |

* cited by examiner

*Primary Examiner* — David J Walczak

(74) *Attorney, Agent, or Firm* — Oblon, McClelland, Maier & Neustadt, L.L.P.

(57) ABSTRACT

An apparatus for applying cosmetic solutions includes: a holder, including a cap, a stem, and a brush; and a bottle configured to hold a solution, wherein the brush is disposed at a first end of the stem and a second end of the stem is attached to the cap; the stem includes an absorbing structure configured to absorb the solution; and the brush is configured to wick the solution from the absorbing structure of the stem.

11 Claims, 5 Drawing Sheets

APPARATUS WITH STRUCTURED STEM FOR COSMETIC APPLICATION

BACKGROUND

Field of the Invention

The application generally relates to an apparatus including a structured stem for solution absorption and metered solution delivery to a brush during cosmetic application.

SUMMARY

In an embodiment, the present disclosure relates to an apparatus for makeup removal, including, among other things, a holder, including a cap, a stem, and a brush; and a bottle configured to hold a solution, wherein the brush is disposed at a first end of the stem and a second end of the stem is attached to the cap; the stem includes an absorbing structure configured to absorb the solution; and the brush is configured to wick the solution from the absorbing structure of the stem.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
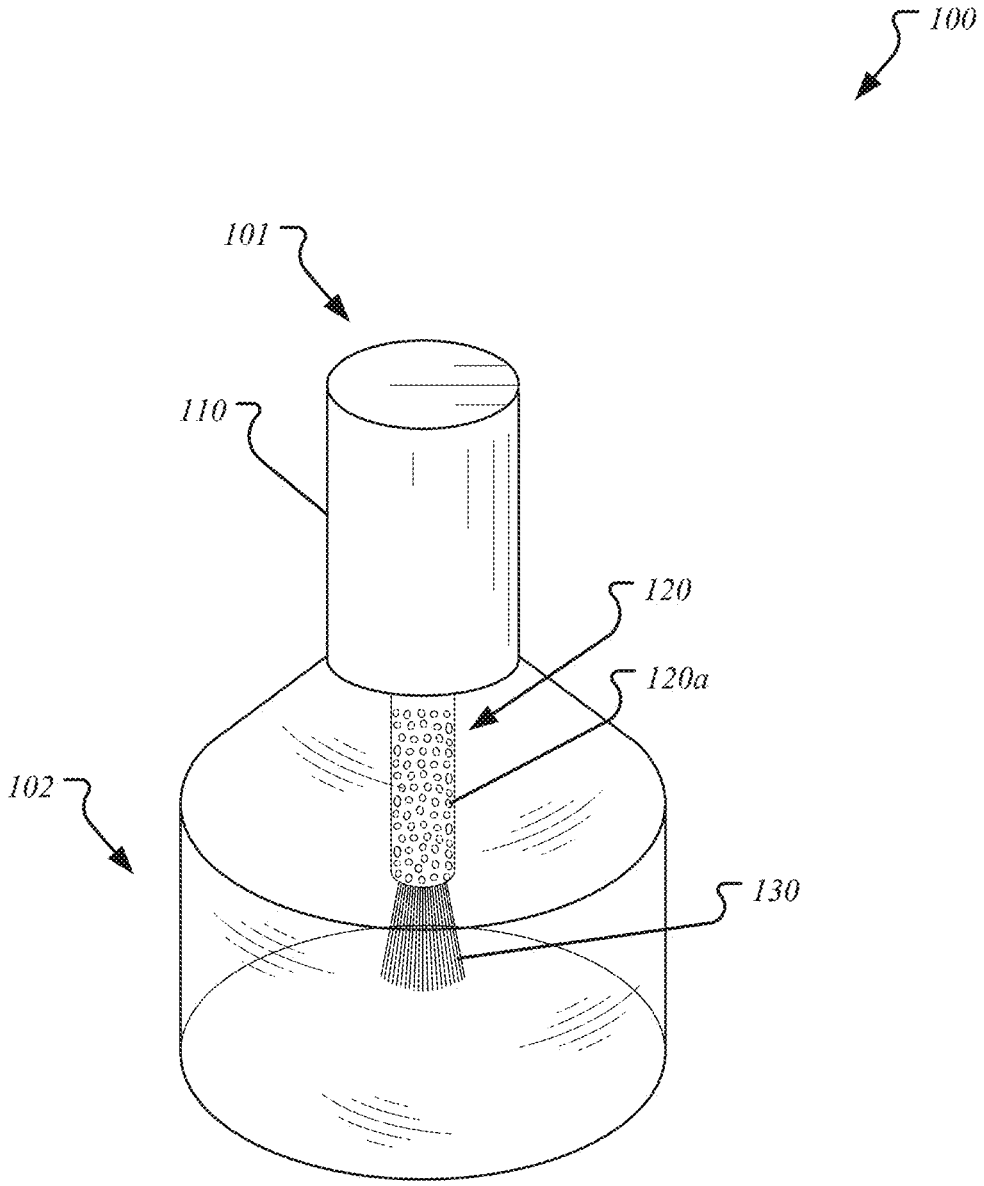
FIG. 1 is a perspective view schematic of a cosmetic applicator apparatus, according to an exemplary embodiment of the present disclosure.

FIG. 1 illustrates a perspective view of a cosmetic applicator 100, according to an exemplary embodiment of the present disclosure. In an embodiment, the cosmetic applicator 100 includes a holder 101 and a bottle 102.

Figure 2A:
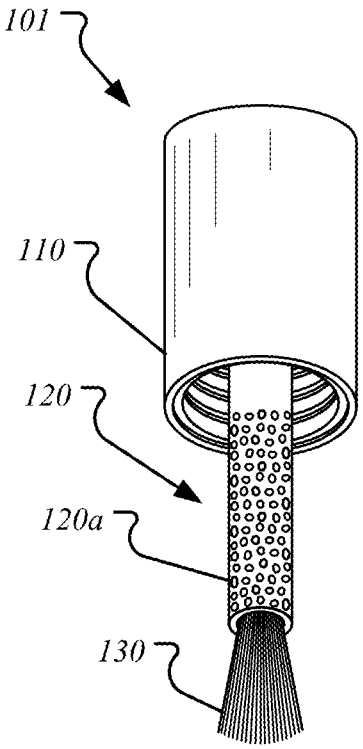
FIG. 2A is a perspective view schematic of a holder, according to an exemplary embodiment of the present disclosure.
Figure 2B:
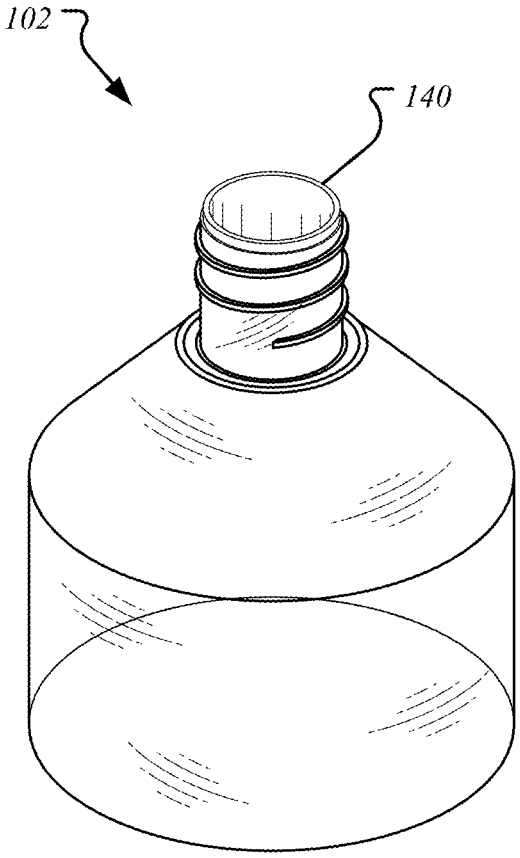
FIG. 2B is a perspective view schematic of a bottle, according to an exemplary embodiment of the present disclosure.

FIG. 2A illustrates a perspective view of the holder 101, according to an exemplary embodiment of the present disclosure. In an embodiment, the holder 101 includes a cap 110, a stem 120, and a brush 130. FIG. 2B illustrates a perspective view of the bottle 102, according to an exemplary embodiment of the present disclosure. In an embodiment, the bottle 102 includes a neck 140 disposed at a first end, and the bottle 102 is configured to hold a solution, such as a cosmetic solution. An inner diameter of the cap 110 is marginally wider than an outer diameter of the neck 140. In an embodiment, the bottle 102 includes a wiper to remove excess solution accumulated on the stem 120.

In an example, the cap 110 includes an interior sidewall surface that is threaded and configured to twistably couple with the neck 140, wherein the neck 140 includes an exterior surface that is threaded (as shown). In another example, the holder 101 is configured to snap-tighten onto the neck 140. The brush 130 is disposed at a first end of the stem 120. The stem 120 is attached to an interior of the cap 110 at a second end of the stem 120. The cap 110 is configured to couple with the bottle 102, wherein the brush 130 and the first end of the stem 120 are inserted into the neck 140 first.

Figure 2C:
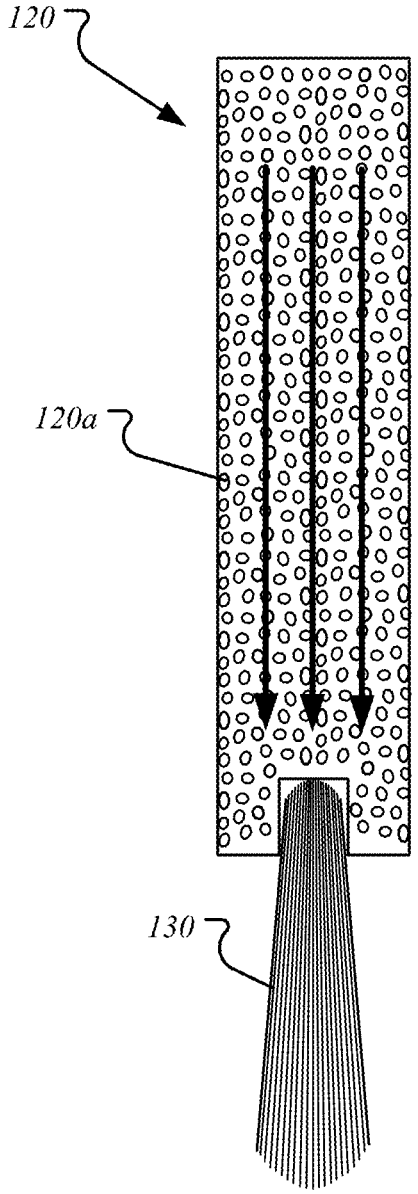
FIG. 2C is a cross-sectional view schematic of a stem, according to an exemplary embodiment of the present disclosure.

FIG. 2C illustrates a cross-sectional view of the stem 120, according to an exemplary embodiment of the present disclosure. In an embodiment, the stem 120 includes a solid core and a plurality of pores 120*a*. A shallow volume inside the stem 120 is hollowed out and bristles of the brush 130 are secured in the shallow volume. The plurality of pores 120*a* comprising the remaining portion of the solid core are configured to absorb the solution by capillary action and, over time, dispense the solution to the brush 130. That is, mass transport of the solution to the brush 130 proceeds in a direction substantially along a length axis of the stem 120 and towards the brush 130.

Figure 2D:
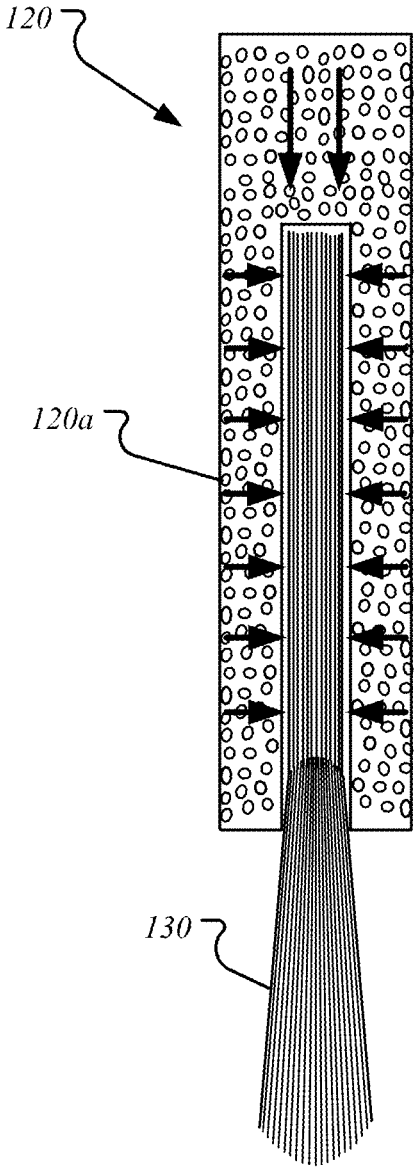
FIG. 2D is a cross-sectional view schematic of a stem, according to an exemplary embodiment of the present disclosure.

FIG. 2D illustrates a cross-sectional view of the stem 120, according to an exemplary embodiment of the present disclosure. In an embodiment, the stem 120 includes a substantially hollow core. A deep volume inside the stem 120 is hollowed out and bristles of the brush 130 are secured in the deep volume, wherein the bristles (which are longer in length) substantially extend into the deep volume. The plurality of pores 120*a* comprising a remaining outer wall of the hollow core are configured to absorb the solution by capillary action and, over time, dispense the solution to the bristles of the brush 130 disposed in the hollow core. That is, mass transport of the solution to the brush 130 proceeds in a direction substantially orthogonal to the length axis of the stem 120. When the solution is consumed (i.e. when the brush 130 is used to apply the solution), mass transport of the solution then proceeds in a direction along the length axis of the stem 120. That is, solution is carried via capillary action down the length of the bristles towards the exposed portion of the brush 130 where solution is consumed.

In an example, the stem 120 is fabricated by sintering a material comprising microbeads to induce the porosity in the stem 120. A diameter of the microbeads (i.e. each of the plurality of pores 120*a*) is, for example, 25 um to 250 um, or 25 um to 500 um. The smaller size of the plurality of pores 120*a* may be suitable for water-thin solutions, whereas the larger size of the plurality of pores 120*a* may be suitable for viscous solutions. Non-limiting examples of water-thin solutions suitable for smaller pore sizes includes at least one of a solution with volatiles, a solution impregnated with pigment particles, a solution including emollients, and a solution including an active medication, or any combination thereof. Non-limiting examples of viscous solutions suitable for larger pore sizes includes at least one of nail polish, mascara, eyebrow tint, concealer, foundation, creams, lotions, ointments, and gels, or any combination thereof. Non-limiting examples of materials for the microbeads includes at least one of polypropylene, polyester, and polyethylene, or any combination thereof. In another example, the stem 120 is fabricated from compressed fibers. In general, the absorption of the stem 120 is proportional to the wettability of the material for the plurality of pores 120*a* and inversely proportional to the diameter of each of the plurality of pores 120*a*.

Figure 3A:
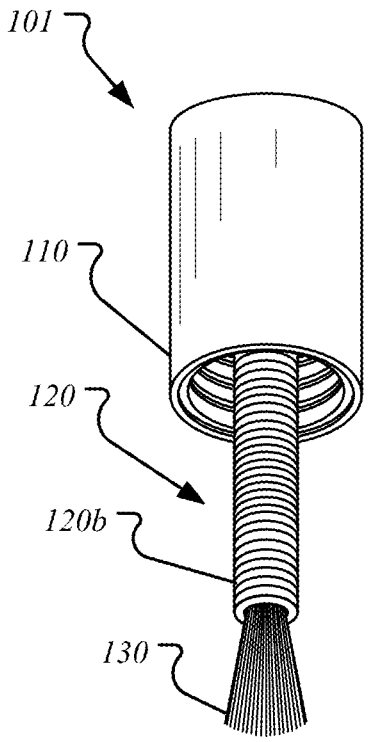
FIG. 3A is a perspective view schematic of a holder including a stem with fins, according to an embodiment of the present disclosure.

FIG. 3A illustrates a perspective view of the holder 101 including the stem 120 with fins, according to an exemplary embodiment of the present disclosure. In an embodiment, the stem 120 includes a plurality of fins 120*b* oriented such that a plane of each of the plurality of fins 120*b* is substantially perpendicular to the length axis of the stem 120. The plurality of fins 120*b* are oriented radially parallel to each other along the length of the stem 120, wherein each of the plurality of fins 120*b* is spaced apart a predetermined distance from an adjacent one of the plurality of fins 120*b*.

Figure 3B:
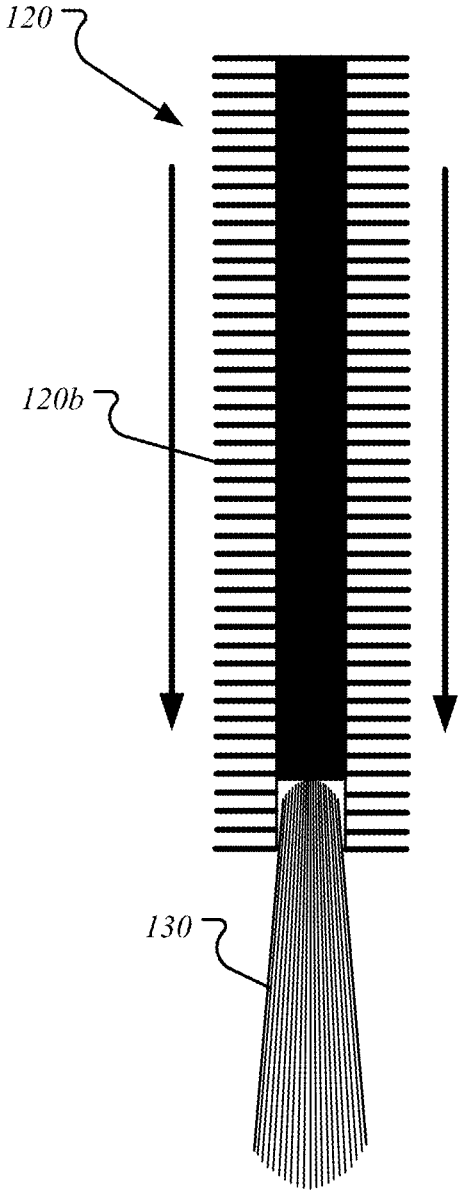
FIG. 3B is a cross-sectional view schematic of a finned stem, according to an exemplary embodiment of the present disclosure.

FIG. 3B illustrates a cross-sectional view schematic of the finned stem 120, according to an exemplary embodiment of the present disclosure. In an embodiment, the stem 120 includes a solid core. A shallow volume inside the stem 120 is hollowed out and bristles of the brush 130 are secured in the shallow volume. The plurality of fins 120*b* attached to the solid core span the length of the stem 120. The plurality of fins 120*b* are configured to absorb the solution by capillary action between each of the plurality of fins 120*b*. As solution is consumed by the brush 130, solution flows towards the brush 130. That is, mass transport of the solution to the brush 130 proceeds in a direction substantially along the length axis of the stem 120 and towards the brush 130.

Figure 3C:
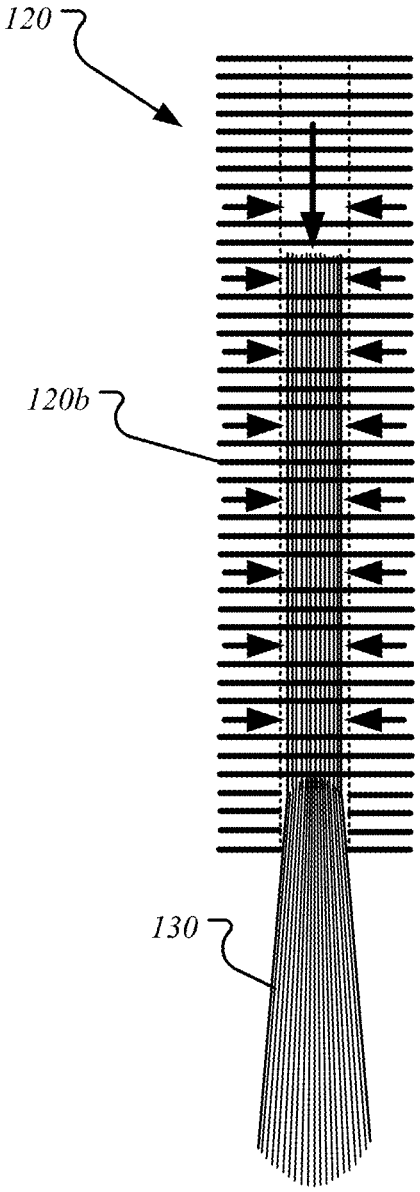
FIG. 3C is a cross-sectional view schematic of a finned stem, according to an exemplary embodiment of the present disclosure.

FIG. 3C illustrates a cross-sectional view schematic of the finned stem 120, according to an exemplary embodiment of the present disclosure. In an embodiment, the stem 120 includes a hollow core. A deep volume inside the stem 120 is hollowed out and bristles of the brush 130 are secured in the deep volume, wherein the bristles (which are longer in length) substantially extend into the deep volume. The plurality of fins 120*b* are attached to a remaining outer wall spanning the length of the stem 120. The remaining outer wall surrounding the hollow core includes through-holes that allow solution to flow from in between each of the plurality of fins 120*b* to the hollow core where the bristles are disposed. The plurality of fins 120*b* are configured to absorb the solution by capillary action and, over time, dispense the solution to the bristles of the brush 130. That is, mass transport of the solution to the brush 130 proceeds in a direction substantially orthogonal to the length axis of the stem 120. When the solution is consumed (i.e. when the brush 130 is used to apply the solution), mass transport of the solution then proceeds in a direction along the length axis of the stem 120. That is, solution is carried via capillary action down the length of the bristles towards the exposed portion of the brush 130 where solution is consumed.

In an embodiment, the plurality of fins 120*b* are oriented along the stem 120 wherein the plane of each of the plurality of fins 120*b* is substantially parallel to the length axis of the stem. This allows solution to be absorbed between each of the plurality of fins 120*b*, but will release the solution in a direction towards the brush 130 more quickly as compared to the plurality of fins 120*b* oriented such that a plane of each of the plurality of fins 120*b* is substantially perpendicular to the length axis of the stem 120. In an embodiment, the plurality of fins 120*b* are spiraled around the stem 120, allowing for an intermediate solution release rate as compared to the plane of each of the plurality of fins 120*b* being substantially parallel to the length axis of the stem and the plane of each of the plurality of fins 120*b* being substantially perpendicular to the length axis of the stem.

Notably, a volume of solution absorbed by the plurality of fins 120*b* is inversely proportional to the distance between each of the plurality of fins 120*b*. Thus, varying the predetermined distance between each of the plurality of fins 120*b* may adjust the volume of solution absorbed by the plurality of fins 120*b*. Moreover, varying the material choice may adjust the volume of solution absorbed due to adhesion interactions between different solutions with different materials. For example, a hydrophobic material choice for the plurality of fins 120*b* may absorb less water between each of the plurality of fins 120*b* as compared to a hydrophilic material.

Advantageously, the stem 120 including the plurality of pores 120*a* or the plurality of fins 120*b* absorbs more of the solution and retains it during cosmetic application by a user. The stem 120 in this sense acts as a capacitor and slowly feeds the stored/retained solution to the brush 130. Notably, the selected structure for the stem 120, the material choice, and the size of the plurality of pores 120*a* or the plurality of fins 120*b* may adjust the rate at which the solution flows from the stem 120 material to the bristles in the brush 130 for application. In an example, the brush 130 depletes the solution at a slower rate than the stem 120 feeds the solution to the brush 130, thus ensuring the brush 130 always contains solution to apply. As compared to other non-structured applicator stems, such as a solid cylindrical stem, the user benefits from a decreased frequency of dipping the stem 120 and brush 130 in the solution as well as a controlled release of solution stored in the stem 120 to the brush 130.

The description above in connection with the appended drawings is intended as a description of various embodiments of the disclosed subject matter and is not necessarily intended to represent the only embodiment(s). In certain instances, the description includes specific details for the purpose of providing an understanding of the disclosed subject matter. However, it will be apparent to those skilled in the art that embodiments may be practiced without these specific details. In some instances, well-known structures and components may be shown in block diagram form in order to avoid obscuring the concepts of the disclosed subject matter.

Reference throughout the specification to "one aspect", "one embodiment", "an aspect", or "an embodiment" means that a particular feature, structure, characteristic, operation, or function described in connection with an embodiment is included in at least one embodiment of the disclosed subject matter. Thus, any appearance of the phrases "one aspect", "one embodiment", "an aspect", or "an embodiment" in the specification is not necessarily referring to the same aspect or embodiment. Further, the particular features, structures, characteristics, operations, or functions may be combined in any suitable manner in one or more aspects or embodiments. Further, it is intended that aspects or embodiments of the disclosed subject matter can and do cover modifications and variations of the described aspects or embodiments.

It must be noted that, as used in the specification and the appended claims, the singular forms "a," "an," and "the" include plural referents unless the context clearly dictates otherwise. That is, unless clearly specified otherwise, as used herein the words "a" and "an" and the like carry the meaning of "one or more." Additionally, it is to be understood that terms such as "upper," "lower," "front," "rear,"

"side," "interior," "exterior," and the like that may be used herein, merely describe points of reference and do not necessarily limit embodiments of the disclosed subject matter to any particular orientation or configuration. Furthermore, terms such as "first," "second," "third," etc., merely identify one of a number of portions, components, points of reference, operations and/or functions as described herein, and likewise do not necessarily limit embodiments of the disclosed subject matter to any particular configuration or orientation.

A number of embodiments have been described. Nevertheless, it will be understood that various modifications are made without departing from the spirit and scope of this disclosure. For example, preferable results are achieved if the steps of the disclosed techniques were performed in a different sequence, if components in the disclosed systems were combined in a different manner, or if the components were replaced or supplemented by other components.

The foregoing discussion describes merely exemplary embodiments of the present disclosure. As will be understood by those skilled in the art, the present disclosure may be embodied in other specific forms without departing from the spirit or essential characteristics thereof. Accordingly, the disclosure is intended to be illustrative, but not limiting of the scope of the disclosure, as well as the claims. The disclosure, including any readily discernible variants of the teachings herein, defines in part, the scope of the foregoing claim terminology such that no inventive subject matter is dedicated to the public.

The invention claimed is:

1. An apparatus for applying cosmetic solutions, comprising:

a holder, including a cap, a stem, and a brush; and a bottle configured to hold a solution, wherein the brush is disposed at a first end of the stem and a second end of the stem is attached to the cap;

the stem includes an absorbing structure configured to absorb the solution, the absorbing structure including an outer wall surrounding a core configured to hold bristles of the brush, the outer wall including a plurality of pores formed into the outer wall, each pore of the plurality of pores passing through the outer wall, the plurality of pores configured to absorb the solution and transport the solution through the outer wall; and the brush is configured to wick the solution from the plurality of pores of the absorbing structure of the stem.

2. The apparatus of claim 1, wherein the stem includes a solid core.

3. The apparatus of claim 1, wherein the stem includes a hollow core and bristles of the brush extend a distance into the hollow core.

4. The apparatus of claim 3, wherein the bristles of the brush disposed in the hollow core of the stem wick solution absorbed in the plurality of pores.

5. The apparatus of claim 1, wherein the solution is absorbed in the stem; and in response to contact between the brush and a surface, solution depleted at the brush is replenished by wicking solution absorbed in the stem.

6. An apparatus for applying cosmetic solutions, comprising:

a holder, including a cap, a stem, and a brush, wherein the brush is disposed at a first end of the stem and a second end of the stem is attached to the cap;

the stem includes an absorbing structure configured to absorb a solution, the absorbing structure including an outer wall surrounding a core configured to hold bristles of the brush, the outer wall including a plurality of pores formed into the outer wall, each pore of the plurality of pores passing through the outer wall, the plurality of pores configured to absorb the solution and transport the solution through the outer wall; and the brush is configured to wick a solution from the plurality of pores of the absorbing structure of the stem.

7. The apparatus of claim 6, wherein the stem includes a solid core.

8. The apparatus of claim 6, wherein the stem includes a hollow core and bristles of the brush extend a distance into the hollow core.

9. The apparatus of claim 8, wherein the bristles of the brush disposed in the hollow core of the stem wick solution absorbed in the plurality of pores.

10. An apparatus for applying cosmetic solutions, comprising:

a holder, including a cap, a stem, and a brush; and a bottle configured to hold a solution, wherein the brush is disposed at a first end of the stem and a second end of the stem is attached to the cap;

the stem includes a hollow core and an absorbing structure configured to absorb the solution;

a plurality of fins are attached to an outer wall surrounding the hollow core spanning a length of the stem;

bristles of the brush extend a distance into the hollow core; and the brush is configured to wick the solution from the absorbing structure of the stem.

11. The apparatus of claim 10, wherein the outer wall surrounding the hollow core includes a plurality of through-holes configured to allow solution to flow from in between each of the plurality of fins to the hollow core; and the bristles of the brush disposed in the hollow core of the stem wick solution absorbed in between the plurality of fins through the plurality of through-holes.

* * * * *